United States Patent [19]

Romaine

[11] Patent Number: 4,953,315

[45] Date of Patent: Sep. 4, 1990

[54] DISPLAY DEVICE FOR VEHICLES

[76] Inventor: Richard A. Romaine, 475 SW. View Crest Dr., Gresham, Oreg. 97080

[21] Appl. No.: 290,425

[22] Filed: Dec. 27, 1988

[51] Int. Cl.[5] ..... G09F 21/04

[52] U.S. Cl. ..... 40/593; 40/424; 40/488; 40/597; 116/44

[58] Field of Search ..... 40/593, 425, 424, 486, 40/488, 491, 490, 591, 597; 116/44, 50, 203, 215; 248/205.5, 206.3, 206.4

[56] References Cited

U.S. PATENT DOCUMENTS

| | | | |
|---|---|---|---|
| 176,228 | 4/1876 | Kayser . | |
| 338,463 | 3/1886 | Barrett . | |
| 380,166 | 3/1888 | Benninghaus | 40/488 |
| 1,556,511 | 10/1925 | Dobbins . | |
| 1,583,720 | 5/1926 | Jacobs | 248/206.3 |
| 1,812,159 | 6/1931 | Lukas | 40/491 |
| 1,854,514 | 4/1932 | Ishbia | 116/44 |
| 2,631,395 | 3/1953 | Barker | 40/425 |
| 2,797,514 | 7/1957 | Toulmin | 40/485 |
| 2,798,321 | 7/1957 | Duff | 40/485 |
| 2,828,562 | 4/1958 | Warren | 40/493 |
| 2,897,617 | 8/1959 | Haupt | 40/491 |
| 2,961,788 | 11/1960 | Halperin | 40/446 |
| 3,248,809 | 5/1966 | Stifano, Jr. | 40/491 |
| 3,388,490 | 6/1968 | Stechemesser | 40/406 |
| 3,842,523 | 10/1974 | Yumoto | 40/491 |
| 3,936,967 | 2/1976 | Davis | 40/597 |
| 4,149,330 | 4/1979 | Huff | 40/491 |
| 4,485,576 | 12/1984 | Greenberger | 40/491 |
| 4,731,945 | 3/1988 | Howard | 40/488 |

FOREIGN PATENT DOCUMENTS

| | | | |
|---|---|---|---|
| 441846 | 1/1936 | United Kingdom | 40/491 |

*Primary Examiner*—Kenneth J. Dorner
*Assistant Examiner*—Brian K. Green
*Attorney, Agent, or Firm*—Eugene D. Farley

[57] ABSTRACT

A display device for automobiles and other vehicles alternately displays two different messages in an interesting manner calculated to attract attention. The device comprises an outer case having a plurality of spaced windows and, mounted within the case, a slide having a plurality of spaced indicia spelling out the two messages. Windows and indicia are positioned in such a manner that upon relative movement of slide and case, produced by inertial, centrifugal or gravitational forces generated by the vehicle movement, the slide alternates between two positions within the case, thereby alternately spelling out the two messages.

5 Claims, 1 Drawing Sheet

DISPLAY DEVICE FOR VEHICLES

BACKGROUND AND GENERAL STATEMENT OF THE INVENTION

This invention relates to changeable display devices adapted for mounting on an automobile or other vehicle and which has the capacity for displaying messages alternately for purposes of advertising, promotion, education, or amusement.

It is the general purpose of the present invention to provide such a device:

which is actuated solely by forces generated by motion of the vehicle without requiring an external power source;

which is easily mounted and demounted on a selected surface of the vehicle where it is presented effectively to view by passers by and occupants of other vehicles;

which is so constructed as to make possible the changing of the messages displayed by the device with speed and facility;

which is self-lubricating; and which is simple in construction, of low cost, easily maintained, and effective in achieving its desired purpose, namely that of attracting the attention of others in the vicinity and delivering the desired message.

The foregoing and other objects of the present invention are achieved by the provision of a display device for vehicles which, broadly considered, comprises an elongated case and mounting means for mounting the case on a selected surface of a vehicle with its front face outermost. The front face has along its length a plurality of spaced display windows.

An elongated slide is mounted on the case for reciprocating sliding movement. Its front face underlies the front face of the case. On the front face of the slide are a plurality of spaced indicia positioned for viewing through the windows in the case and spelling out a first message and a second message.

Stop means limit the reciprocating movement of the slide between first and second positions. The spacings of the windows in the case and the indicia on the slide are predetermined to present to view a first message when the slide is shifted to its first position by application of a displacing force, such as the centrifugal force generated by swaying of the vehicle, and to present to view a second message when the slide is shifted to its second position upon the application of such force in the opposite direction.

THE DRAWINGS

DESCRIPTION OF A PREFERRED EMBODIMENT OF THE INVENTION

Figure 1:
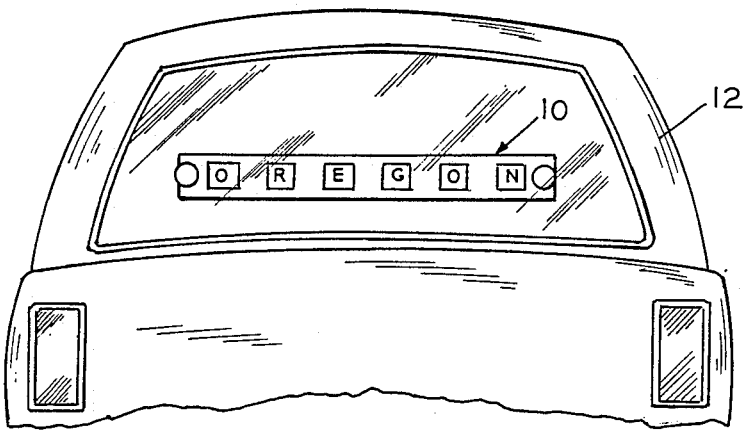
FIG. 1 is a fragmentary view in elevation of the rear of an automobile having the described display device mounted on the rear window.
Figure 2:
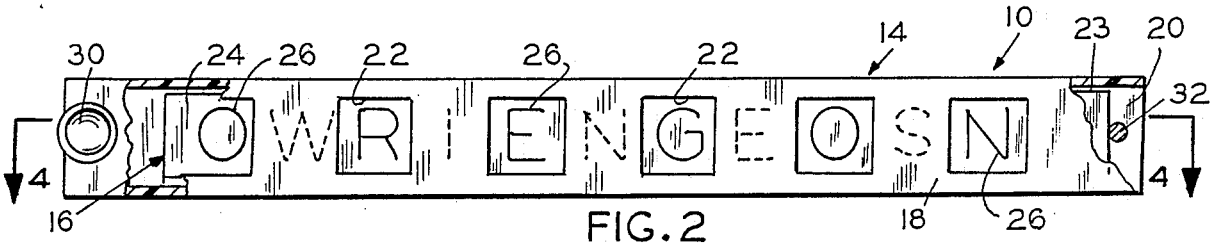
FIGS. 2 and 3 are views in elevation, partly in section, of the display device in its first and second positions in which it alternately displays first and second messages.
Figure 3:
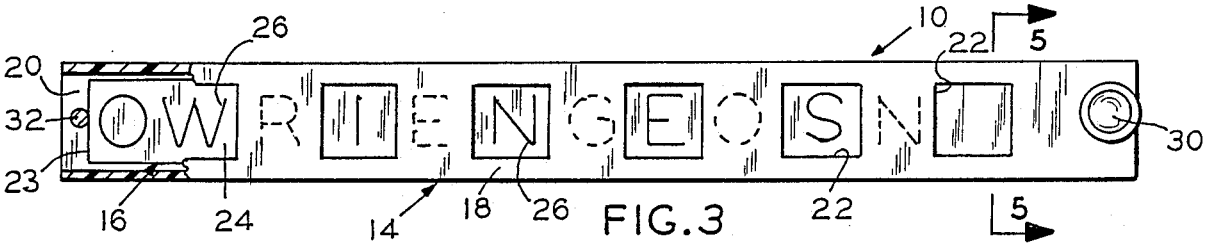

As illustrated in FIG. 1, the herein described display device 10 is adapted for mounting on a selected surface of a vehicle, for example the rear surface of an automobile 12. As illustrated it may be mounted to advantage on the rear window thereof where it is subject to viewing both by following vehicles and passers by. However, it also may be mounted on the trunk of the vehicle, or even on a side surface. It also may be mounted on selected surfaces of other vehicles, such as boats, trains, and the like.

The construction of the device is particularly apparent from FIGS. 2–6.

As shown in these figures, the device comprises a case indicated generally at 14, a slide mounted within the case and indicated generally at 16, mounting means for mounting the case to the vehicle, and stop means for limiting the sliding movement of the slide within the case between first and second positions.

Case 14 is elongated and has a length determined by such factors as the length of the message to be displayed, the mounting space available, and the like. In the illustration, it is rectangular in cross section although it may assume various other configurations.

The case has a front face 18 and a back face 20. Its longitudinal ends are open to facilitate changing the message to be displayed, as well as to facilitate lubrication of the device, should lubrication be necessary.

Front face 18 has along its length a plurality of spaced display windows 22 through which the message carried by the device is displayed.

Slide 16 also may be made of plastic, preferably a solid piece of self-lubricating plastic of substantial weight. It has a slide body 23 and front face 24 which underlies the front face 18 of the case. On the front face it bears a plurality of spaced indicia 26. These are positioned for viewing through windows 22, spelling out a first message in the first position of the slide and a second message in the second position of the slide.

To make this possible, the first letter of the first message is followed by the first letter of the second message. Succeeding this, the second letter of the first message is followed by the second letter of the second message, and so on. Thus, in the illustration where the first message is OREGON and the second message is WINES, the sequence would be as follows:

O W R I E N G E O S N

Accordingly when the slide is in its first position of adjustment, the letters which will be displayed will spell out the word OREGON. When it is in its second position of adjustment, the letters displayed will form the words WINES.

Figure 6:
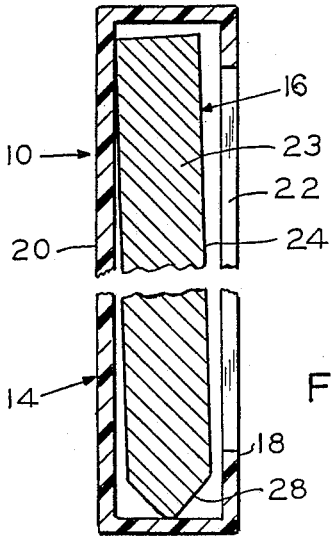
FIG. 6 is an enlarged, fragmentary, sectional view detailing the manner of mounting the slide component within the case component of the herein described display device.

Slide 16 is dimensioned with respect to case 14 in such a manner that there is a clearance between the facing side walls of the two members FIG. 6. Also, the lower longitudinal edge portion 28 of the slide is beveled. As a result, when the slide is encased in the case, it tilts slightly so that the only points of contact are at the top and bottom, respectively, of the assembly. This reduces frictional drag and facilitates movement of the slide within the case.

In the illustrated form of the invention the mounting means employed for mounting the display device on the vehicle comprises, a plurality of suction cups 30. These make possible mounting the device on any selected panel of the vehicle, for example the rear window, as illustrated in FIG. 1.

Figure 4:
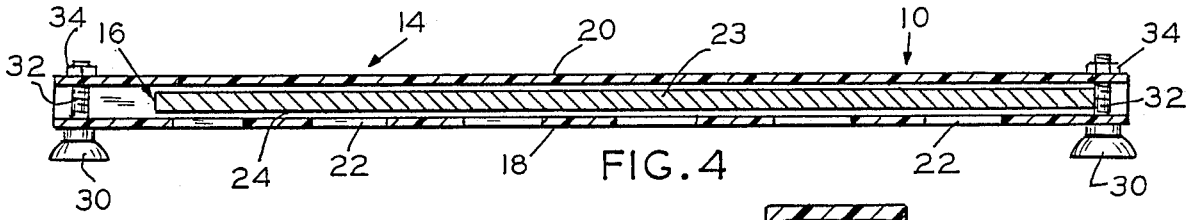
FIG. 4 is a longitudinal sectional view taken along line 4—4 of FIG. 2.
Figure 5:
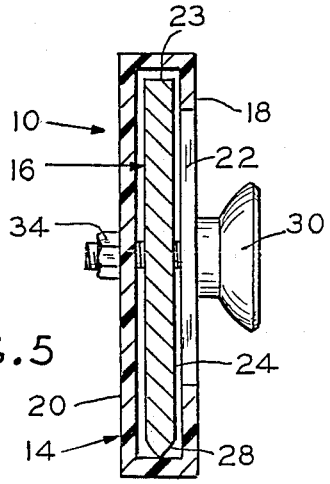
FIG. 5 is a transverse sectional view taken along line 5—5 of FIG. 3.

The suction cups preferably are mounted on threaded posts 32 which penetrate transversely the ends of the case and are of sufficient length to span the distance between the front and back faces of the case in the manner shown particularly in FIGS. 4 and 5. Nuts 34 releasably secure the suction cups to the assembly. As noted above, this arrangement facilitates changing the messages displayed, as well as introducing lubricant into the interior of the case, in the event that lubricant use becomes necessary to insure easy movement of the slide.

It will be seen (FIG. 4) that posts 32 serve the dual functions of mounting the suction cups and also of providing stops which limit the reciprocating motion of slide 16 between the two positions in which the device spells out its respective messages. Thus, in the illustration, when the slide is in its FIG. 2 position, with one edge of the slide abutting the right-hand post 32, the word OREGON is displayed through windows 22. However, when the slide has shifted to the left and assumes its FIG. 3 position, with its other edge abutting left-hand post 32, the word WINES is displayed through the windows.

As the vehicle sways back and forth, the inertia of the slide is responsible for shifting the relative positions of slide and case between the two positions. Similarly, if the device were to be displayed on the side of the vehicle, upon acceleration and deceleration of the vehicle the resulting inertia effect would result in shifting the position of the slide between its two limits.

It is to be noted that although in the illustration the slide is the weighted movable member, and the case is fixed, the assembly could be arranged conversely with the case being weighted and shiftable and the slide in a fixed position. It is the relative movement between these two members of the assembly which is responsible for the alternate display of the two messages.

Having thus described in detail a preferred embodiment of the present invention, it will be apparent to those skilled in the art that various physical changes could be made in the device described herein without altering the inventive concepts and principles embodied. The present embodiment is therefore to be considered in all respects as illustrative and not restrictive, the scope of the invention being indicated by the appended claims rather than by the foregoing description. All changes which come within the meaning and range of equivalency of the claims are therefore to be embraced therein.

I claim:

1. A display device for vehicles, comprising:
(a) an elongated case having a front face and a pair of opposite ends;
(b) suction cup mounting means for mounting the case on a vehicle, with its front face outermost;
(c) the front face having along its length a plurality of spaced display windows;
(d) an elongated slide mounted on the case for reciprocating sliding movement relative to the case and having a front face underlying the front face of the case;
(e) stop means limiting the reciprocating movement of the slide between first and second positions; and
(f) on the front face of the slide a plurality of spaced indicia positioned for viewing through the windows and spelling out first and second messages;
(g) the spacing of the windows in the case and the indicia on the slide being predetermined to present to view the first message when the slide is shifted to its first position by application of a displacing force, and to present to view the second message when the slide is shifted to its second position upon the application of said force,
(h) the ends of the case being open and the suction cup mounting means being positioned one at each end and being provided with mounting posts extending transversely through the case ends, thereby providing the stop means limiting the reciprocating motion of the slide.

2. The display device of claim 1 wherein the slide comprises a weighted member actuatable by the application of inertial or centrifugal displacing force.

3. The display device of claim 1 wherein the slide comprises a weighted member made of self-lubricating, heavy plastic.

4. The display device of claim 1 wherein the slide comprises an elongated piece of material of rectangular cross section having a beveled lower surface positioned to engage the case with minimal frictional contact therewith.

5. The display device of claim 1 wherein the indicia are arranged on the slide to spell out two alternately presented messages in the first and second positions of the slide.

* * * * *